United States Patent [19]

Cody

[11] 4,034,957

[45] July 12, 1977

[54] CONCRETE FORMWORK INCLUDING I-BEAM SUPPORT

[75] Inventor: David L. Cody, Hoffman Estates, Ill.

[73] Assignee: Symons Corporation, Des Plaines, Ill.

[21] Appl. No.: 658,515

[22] Filed: Feb. 17, 1976

[51] Int. Cl.[2] ..... E04C 3/07; E04G 9/04; E04G 17/04

[52] U.S. Cl. ..... 249/189; 52/729; 249/18; 249/219 R; 249/219 W

[58] Field of Search ..... 249/13, 18, 23–25, 249/211, 189, 219 R, 219 W; 52/758 A, 758 C, 729, 372–377, 738, 710, 483, 489

[56] References Cited

U.S. PATENT DOCUMENTS

| | | | |
|---|---|---|---|
| 1,586,053 | 5/1926 | Snyder | 52/738 |
| 1,927,442 | 9/1933 | Laufle | 52/376 |
| 2,129,625 | 9/1938 | Rafter | 52/376 |
| 3,266,209 | 8/1966 | Zibell | 52/758 C |
| 3,267,631 | 8/1966 | Hammitt | 52/758 C |
| 3,336,708 | 8/1967 | Rambelle | 52/376 |
| 3,509,674 | 5/1970 | Birum, Jr. | 52/729 |
| 3,899,152 | 8/1975 | Avery | 249/18 |

*Primary Examiner*—Francis S. Husar
*Assistant Examiner*—John McQuade
*Attorney, Agent, or Firm*—Norman H. Gerlach

[57] ABSTRACT

A multi-purpose, extruded metal, joist-like, structural member which is designed for use in connection with concrete formwork, the member being generally of I-beam configuration and having associated therewith novel facilities whereby it may be nailed, bolted, screw-attached, clamped or otherwise secured to various types of support members (either in the form of lumber or structural metal parts) to the end that it assumes a proper operative position within a concrete wall or slab form installation.

5 Claims, 7 Drawing Figures

CONCRETE FORMWORK INCLUDING I-BEAM SUPPORT

The present invention relates to a novel, extruded metal, joist-like, structural member which is designed for use in connection with concrete formwork, particularly wall or slab form installations, and has associated with it certain novel facilities of adjuncts which may be selectively employed in order to make it possible properly to utilize the member, depending upon the particular character of the concrete form which is undergoing erection and requires use of the member. Such formwork structural member is generally in the form of a modified I-beam which presents, by reason of its specific shape or contour, anchoring facilities whereby one side thereof may be securely affixed to suitable form-supporting or foundation members, and also attachment facilities whereby structural components may conveniently be anchored to its other side. The particular structural member, which as previously stated is generally in the form of an I-beam having special shape characteristics, is adapted when used in connection with a concrete wall form installation to assume the function of a vertical strongback on the outer side of the usual plywood or other paneling of the form; and the outer side of such member has novel facilities whereby a pair of waler boards (hereinafter referred to simply as walers) may be securely clamped to it so that they are in traversing relation with respect to similar structural members forming other parts of the concrete wall form installation. The inner side of the improved structural member has novel facilities whereby the plywood or other paneling may conveniently be affixed to it, the over-all arrangement taking on the general aspects of most conventional concrete wall forms which are made up of strongback and waler reinforced plywood paneling.

When the novel formwork structural member of the present invention is used in connection with a concrete floor slab installation, it extends horizontally and assumes the function of a stringer or joist for supporting the plywood or other deck on which the wet concrete is poured in the production of a slab, it being understood that the same anchoring or attachment facilities will be utilized and hence remain prevalent. Thus, on the lower side of the structural member movel facilities are provided whereby said lower side may be securely affixed or clamped to a fixed supporting structure which may be made up of channel or I-beam type elements which are ground or foundation supported in the case of a first or lower level floor slab or are elevated in the case of an upper level floor slab. On its upper side, the structural member has for attachment to the horizontal plywood deck the same novel facilities as those that are employed in connection with attachment of the member to vertical plywood paneling in the case of use of the member in a concrete wall form installation.

It has previously been indicated that the particular formwork structural member of the present invention, regardless of whether it is used as a vertical strongback in connection with a concrete wall form installation or as a horizontal stringer or joist in connection with a slab form installation, is, in a general way, of I-beam configuration, which is to say that it is provided along the longitudinal edge regions thereof with lateral flange arrangements which are connected together by an intermediate generally planar web. The specific design of such lateral flange arrangements, which when the structural member is horizontal as in a concrete slab installation may be referred to as top and bottom flange arrangements, constitute to a large extent the novelty of the present invention. Instead of providing a single planar lateral I-beam flange at the top and at the bottom of the web, each special flange arrangement of the improved or novel structural member consists of a pair of coplanar flange sections or parts which are separated by a relatively deep channel-forming void, the latter being of irregular design and presenting different channel widths which establish internal channel ledges and ribs within which there may be inserted wooden nailing strips, reinforcing pieces, special anchoring nuts and the like. As the result of the particular design of the flange arrangements of the member, one side of the member may be securely affixed to external form members or plywood paneling by nails, bolts, screws or the like, and the other side of the member may be securely affixed by similar fastening devices to a fixed subjacent supporting structure or the like. Thus, the nature of the channel voids within the top and bottom flange arrangements of the member, to a large extent, constitutes one of the principal features of the invention. Finally, and as will be set forth in greater detail when the nature of the invention is better understood from a consideration of the following detailed description, the interchangeability of lumber and metal parts, either entirely or partially, for use in connection with the novel extruded metal formwork structural member to accomplish the desired attachment facilities, member extension facilities, and member reinforcing facilities, constitutes a further feature of the invention.

The provision of a multi-purpose extruded metal, joistlike formwork structural member and its associated attachment facilities or adjuncts, such as have briefly been outlined above, and possessing the stated advantages, constitutes the principal object of the present invention.

Another object of the invention is to provide an assembly which is in the form of a novel, multi-purpose, extruded metal, structural member and novel connecting and/or attaching facilities and is characterized by the fact that it has many capabilities of use in connection with concrete formwork and other installations, possesses high strength and durability, is light in weight and also capable of comparatively low cost of manufacture, and effectively and efficiently serves its intended purpose.

Other objects and advantages of the invention, not at this time enumerated, will be apparent from the following detailed description.

The invention consists in the several novel features which are hereinafter set forth and are more particularly defined by the claims at the conclusion hereof.

In the accompanying five sheets of drawings forming a part of this specification or disclosure, several illustrative embodiments of the invention are disclosed, one of the views (FIG. 7) of such drawings being in the form of a "scattered" perspective reference view wherein certain parts are duplicated in order to show possible different positions thereof for different combinations in different installations where precise alignment or register of mating parts is not always adhered to and where no single concrete form installation will encompass all of the illustrated parts. By the use of such a view, a large number of additional views in the drawings are obviously unnecessary, while at the same time considerable descriptive matter in the specification has been avoided.

Figure 5:
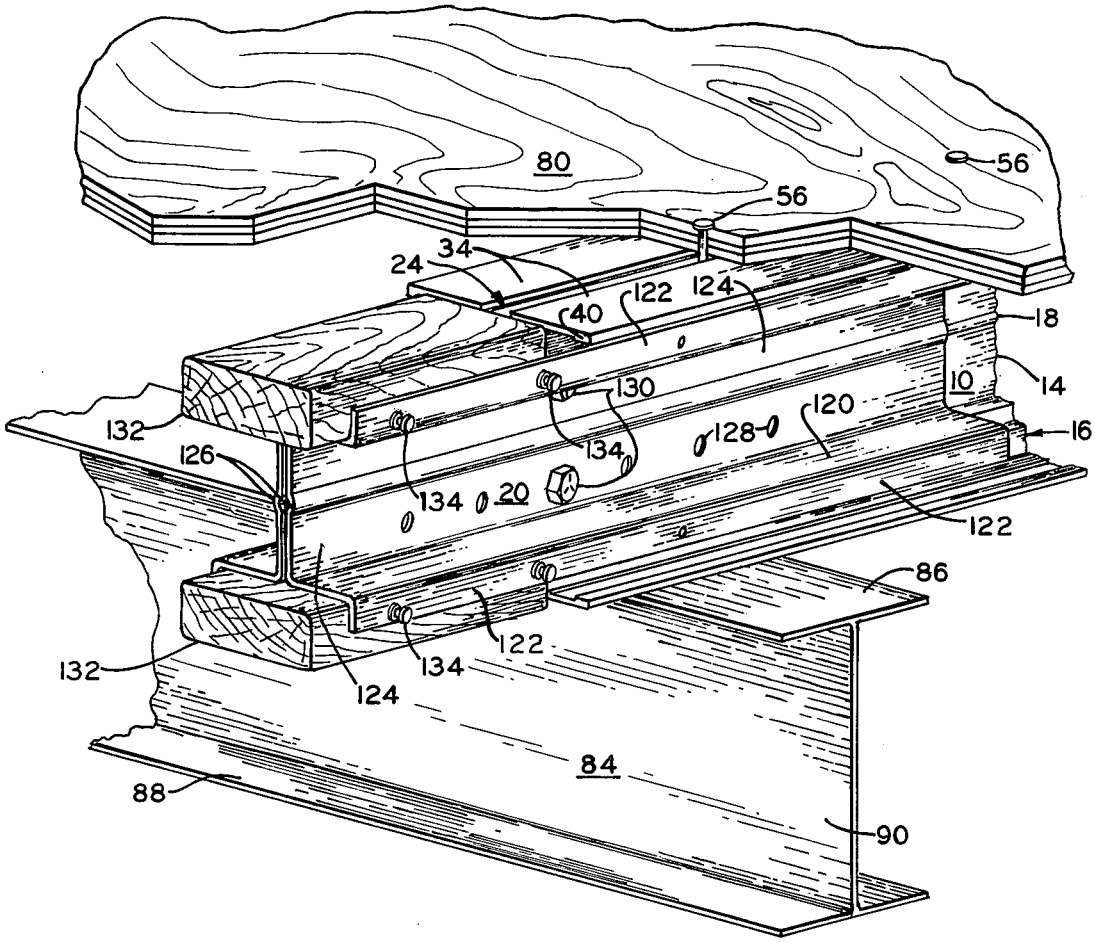
FIG. 5 is a fragmentary perspective view of a concrete slab form installation, showing the structural member in its normal horizontal panel-supporting position, and also showing the same effectively extended in length by means of a pair of novel extruded extender members with associated wooden filler strips disposed therein.
Figure 6:
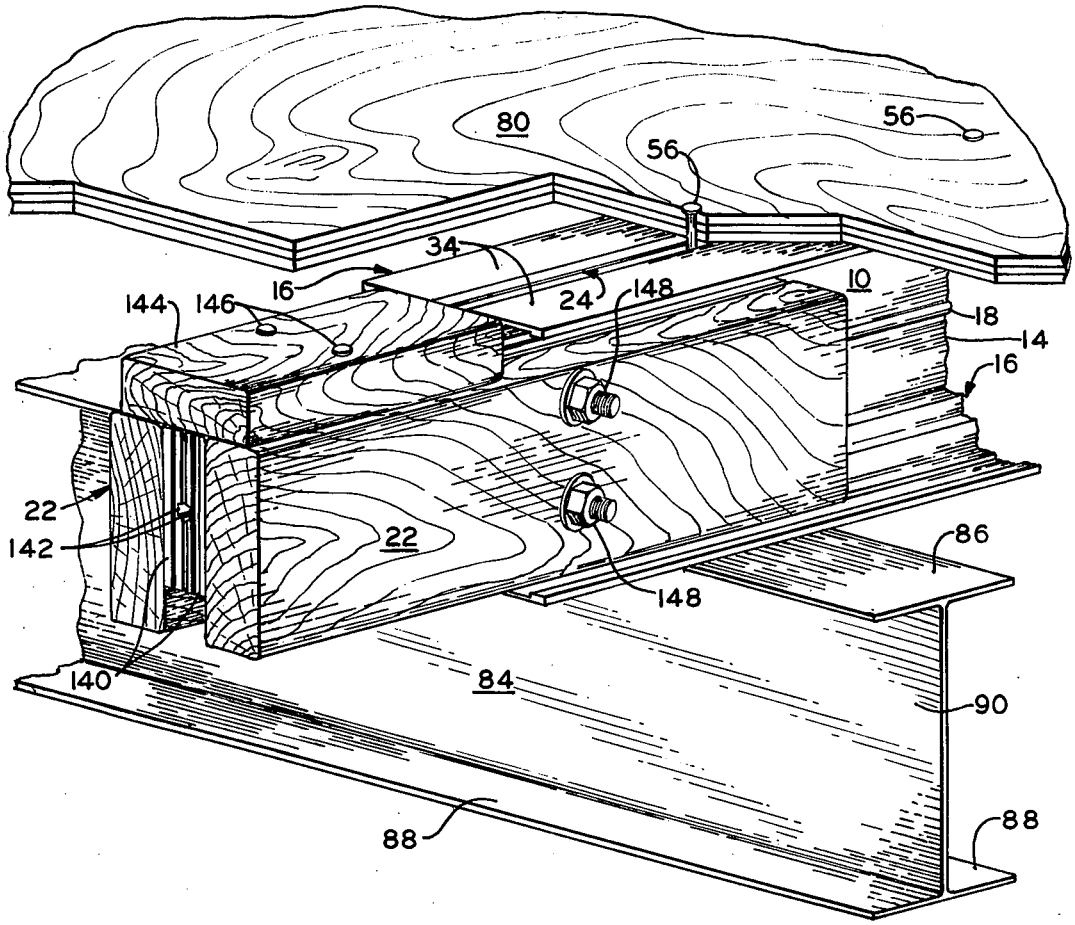
Figure 7:
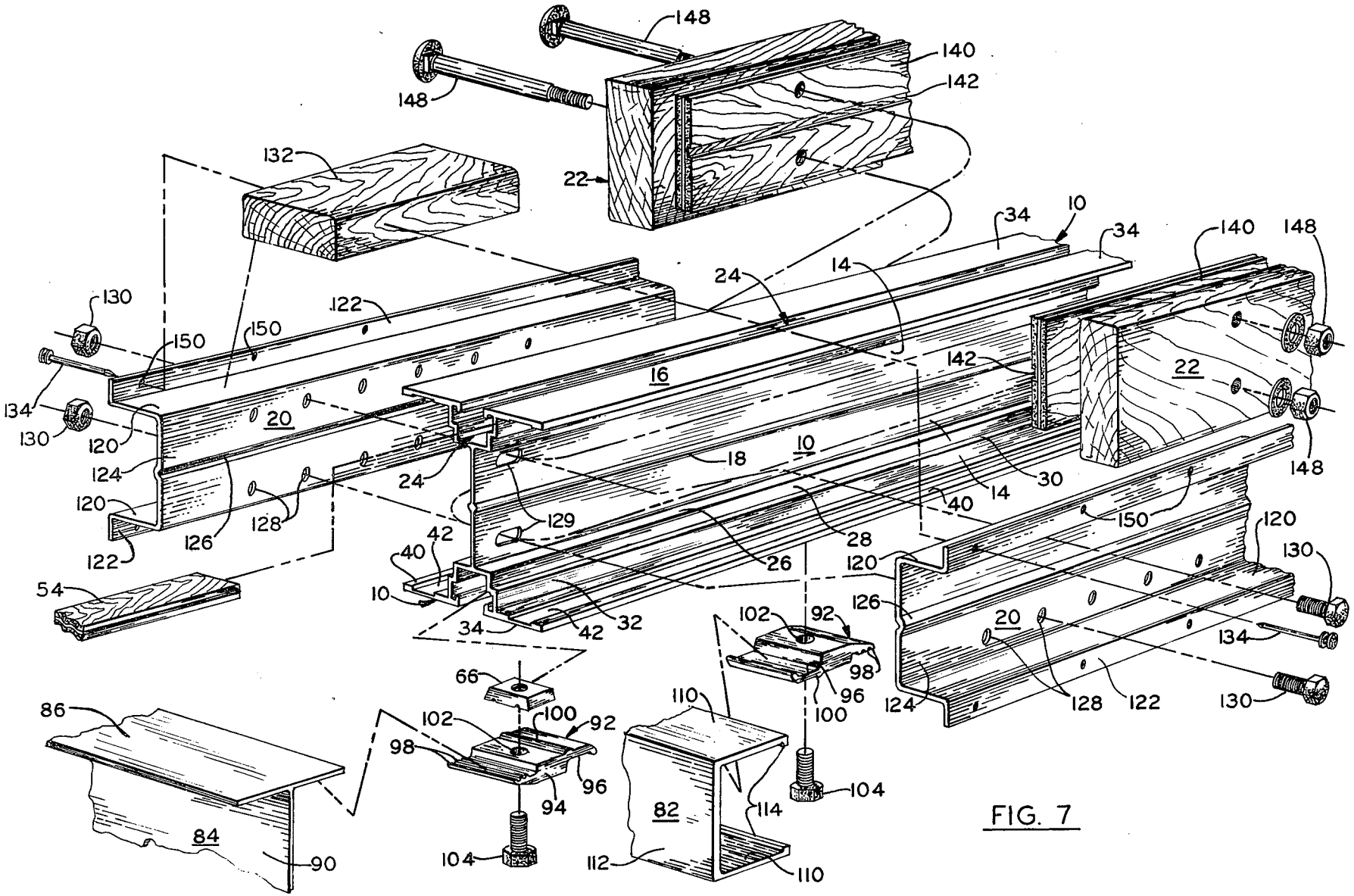

FIG. 6 is a fragmentary perspective view similar to FIG. 5 but showing the structural member extended in length by utilizing pieces of lumber in place of the metal extender members of FIG. 5; and FIG. 7 is an exploded or scattered perspective reference view entirely schematic in its representation and showing the various novel components of the present structural formwork member and its associated extender members, reversible attachment clamps, lumber and other fixtures which are capable of being used in connection with the member in the construction, erection or assembly of a wide variety of concrete forms or portions thereof, the view being illustrative only of the parts involved and with reference to various possible manners of assembly of such parts in combination with one another.

Figure 1:
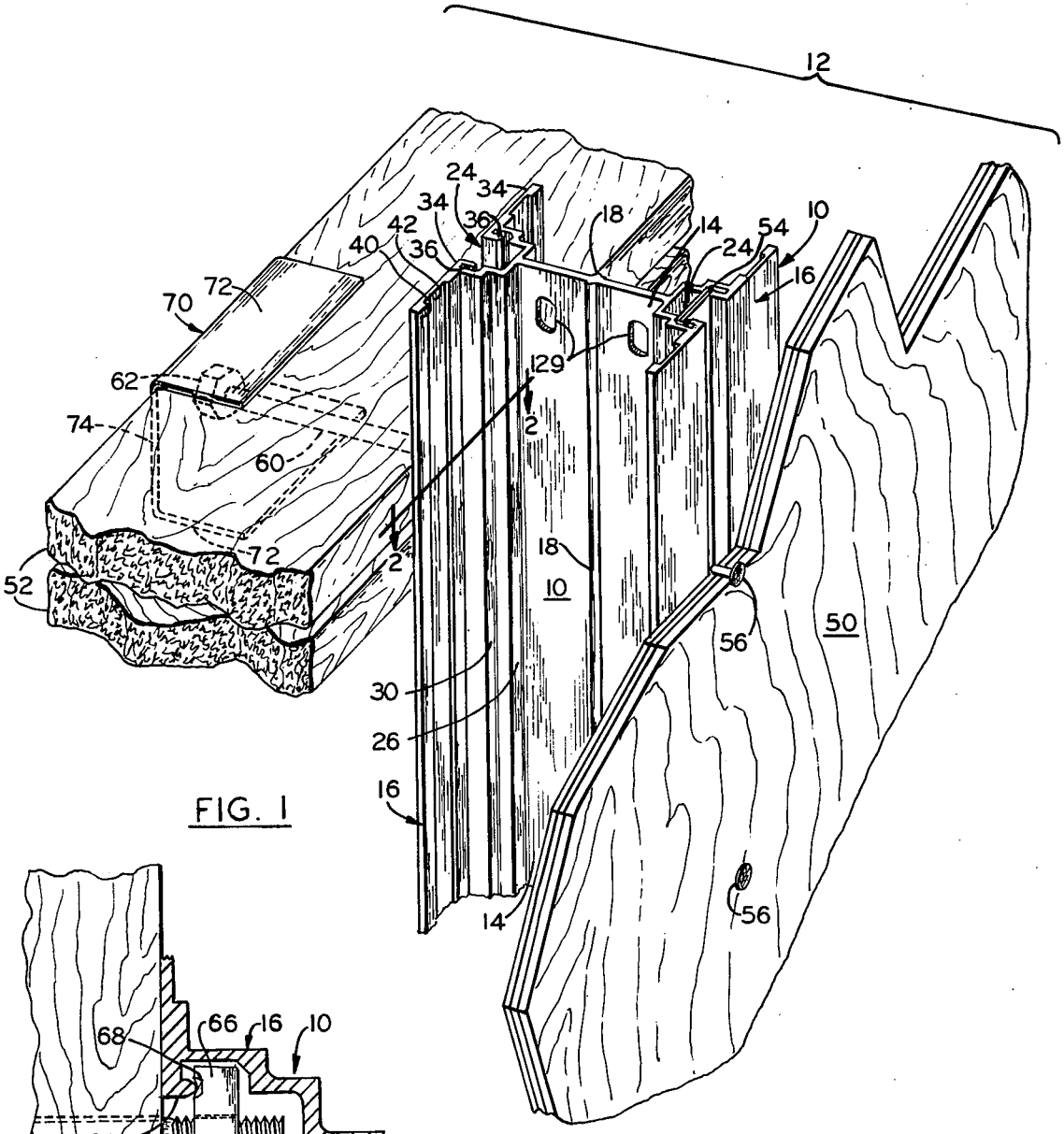
FIG. 1 is a fragmentary perspective view of a concrete wall form installation, showing the improved extruded metal, structural formwork member of the present invention put to use in the manner of a strongback for wall form panel reinforcing and waler supporting purposes.
Figure 2:
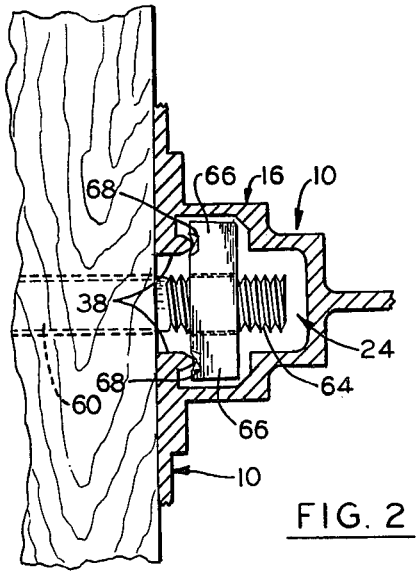
FIG. 2 is an enlarged fragmentary sectional view taken on the horizontal plane indicated by the line 2—2 of FIG. 1 and in the direction of the arrows.
Figure 3:
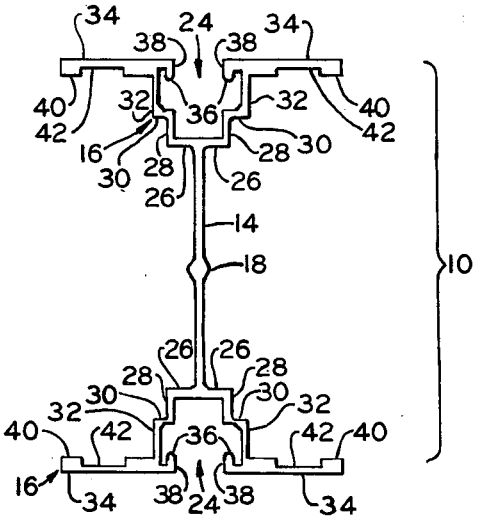
FIG. 3 is an end view of the structural member of FIG. 1.

Referring now to the drawings in detail and in particular to FIGS. 1, 2 and 3, the present invention involves as its principal or basic component a multi-purpose, extruded metal, joist-like, structural member 10. The latter is preferably in the form of an aluminum extrusion and, as shown in FIG. 1, is generally of I-beam configuration. It is capable of a wide variety of uses as will be described or suggested presently, the use to which it is put in the illustration of FIG. 1 being as a vertical strongback in connection with the erection of a concrete wall form which is only fragmentarily disclosed and is designated in its entirety by the reference numeral 12.

The structural member 10 is comprised of an elongated, centrally disposed, substantially flat, solid web 14 and has special flange arrangements 16 integrally formed along its opposite longitudinal edges. The medial longitudinal region of the web 14 of the member 10 is provided with an elongated coextensive thickened rib 18 which not only serves as a reinforcing medium for the web but also is designed for certain mating characteristics with a pair of extruded extender members 20 (see FIGS. 5 and 7), as well as with a pair of wooden extender members 22 (see FIGS. 6 and 7) as will be set forth in detail subsequently.

As best shown in FIG. 3 of the drawings, the two special flange arrangements 16 are identical in construction and, therefore, a description of one (upper flange arrangement) of them will suffice for the other. The upper flange arrangement involves in its general organization a channel-like structure which defines an elongated void or channel 24. The latter is of symmetrical design insofar as its side walls are concerned and has a horizontally extending transverse bottom wall 26 which projects laterally outwardly on opposite sides of the web 14. From the outer edge regions of said bottom wall there projects upwardly a pair of parallel, spaced apart, relatively short first side wall portions 28 the outer edge regions of which are formed with out-turned ledge portions 30. The outer edge regions of such ledge portions 30 are turned upwardly in order to provide additional and somewhat higher second side wall portions 32 which are disposed in parallel relation and are more widely spaced apart than are the shorter first side wall portions 28 as clearly shown in FIG. 3. The inner opposed surfaces of the second side wall portions 32 are smooth and continuous throughout their entire areas, that is, they are not encumbered with any protuberances such as ribs or flanges or the like.

The outer edge regions of the side wall portions 32 of the upper flange arrangement 16 are formed with generally coplanar, horizontally extending, abutment or seating flanges 34. The latter include inwardly extending inside portions having along their inner edge regions down-turned ribs 36 which, in combination with each other, provide a restricted entrance or mouth 38 for the void or channel 24. As clearly shown in FIG. 3, the ribs 36 are rigid and bead-like. Such flanges 34 also include outwardly extending outside portions which have along their outer edge regions down-turned ribs 40 which are relatively wide and the function of which will be described presently. The ribs 40 establish longitudinal grooves 42 on the undersides of the outside portions of the abutment or seating flanges 34.

The lower flange arrangement 16 is, as previously pointed out, exactly the same as the upper flange as the previously-described upper flange arrangement except the parts or components thereof are in an inverted position. When the structural member 10 is used as a strongback and positioned vertically as shown in FIG. 1, the various components of the two flange arrangements are, of course, differently oriented as the result of being positioned at right angles to the position they assume when the member is horizontally arranged.

Referring now to FIGS. 1 and 2 of the drawings wherein the structural member 10 is shown as being operatively installed in and constituting a component of the concrete wall form 12, such wall form embodies the usual plywood or other vertical wall form panel 50 against the inner side of which there is adapted to be poured wet concrete which, when hardened or set, establishes the wall to be formed. It will be understood that the concrete wall form 12 will embody another upstanding panel in opposed and spaced apart relation with the illustrated panel 50 and that additional members 10 (stringers) will be positioned on the outer side of each panel 50 of the concrete wall form 12 in laterally spaced relationship. As is the usual practice, parallel upper and lower walers 52 extend horizontally bridging relation with respect to the vertically positioned spaced apart members 10 on each side of the form 12, such walers being in the form of suitably cut lengths of lumber (wooden boards). The plywood panel 50 is secured to the illustrated structural member 10 by nailing and, toward this end, an elongated plywood or other wooden reaction nailing strip 54 (see FIG. 7) is positioned in the channel 24 in the inner flange arrangement 16 of the member by sliding it endwise into either end of the channel, and the panel 50 is secured to said nailing strip 54 by driving a series of appropriately and vertically spaced nails 56 through the panel 50 and into the strip. If desired, suitable screws (not shown) may be substituted for the nails 56. The wooden nailing strip 54 fits snugly within the channel 24 at the widest region thereof, i.e., it has its side marginal regions confined in the channel portions between the out-turned ledge portions 30, the side wall portions 32, and the ribs 36 (see FIG. 1) with a relatively tight degree of friction. The narrow void or channel which exists between the short side wall portions 28 affords a clearance area for the adjacent ends of the nails or screws to the end that the bottom wall 26 of the inner flange arrangement 16 will present no interference therewith.

The walers 52 are held in clamped position against the outer flange arrangement 16 of the member 10 by a bolt and nut assembly which comprises an elongated, horizontally extending bolt 60 (see FIGS. 1 and 2) having a polygonal head 62 at its outer end and a screw thread 64 at its inner end. Said bolt and nut assembly also comprises a special elongated rectangular nut 66 which is received within the wide portion of the channel 24 of the outer flange arrangement 16 and theadedly receives the screw thread 64 of the inner end of the bolt shank as clearly shown in FIG. 2. The outside face of the rectangular nut 66 is formed with longitudinally and vertically extending grooves 68 which register and interfit with the ribs 38 of the outer flange arrangement 16 so that the side edge regions of the nut 66 are disposed between such ribs 38 and the out-turned ledge portions 30 (see FIG. 2). Associated with the aforementioned bolt and nut assembly is a U-shaped metal waler clamping member 70 which consists of a pair of parallel, spaced apart side flanges 72 and a bight portion 74 between the outer edges of said side flanges. As shown in FIG. 1, the side flanges 70 of the clamping member 70 are arranged in straddled relation with the walers 52 and the bight portion 74 is arranged in abutment with the outer side edges of the walers. Said bight portion of the clamping member 70 has a hole (not shown) through which extends the outer end of the shank of the bolt 60. When the bolt head 62 is turned by a wrench or other suitable tool in order to tighten the bolt, the latter serves to clamp the clamping member 70 against the walers 50 and thereby cause the inner side edges of the walers to be drawn hard against the outer flange arrangement 16 of the structural member 10.

Assembly of the structural member 10 in its proper vertical position on the plywood panel 50 and application of the walers 52 to the member are readily effected by initially sliding the nailing strip 54 endwise into the channel 24 of the inner flange arrangement 16 with a somewhat forced fit as previously described, after which the step of securing the panel to said nailing strip by utilization of the nails 56 is performed. Thereafter, the bolt 60 is passed through the aforementioned hole in the bight portion 74 of the waler clamping member 70 and then manipulated so as to bring the threaded inner end of its shank into the channel 24 and also threaded relation with the nut 66. In connection with this operation, the walers 52 are set in place with the clamping member 70 in straddled relation with it. Thereafter, the bolt 60 is tightened to draw the walers against the member 10 as previously indicated.

Figure 4:
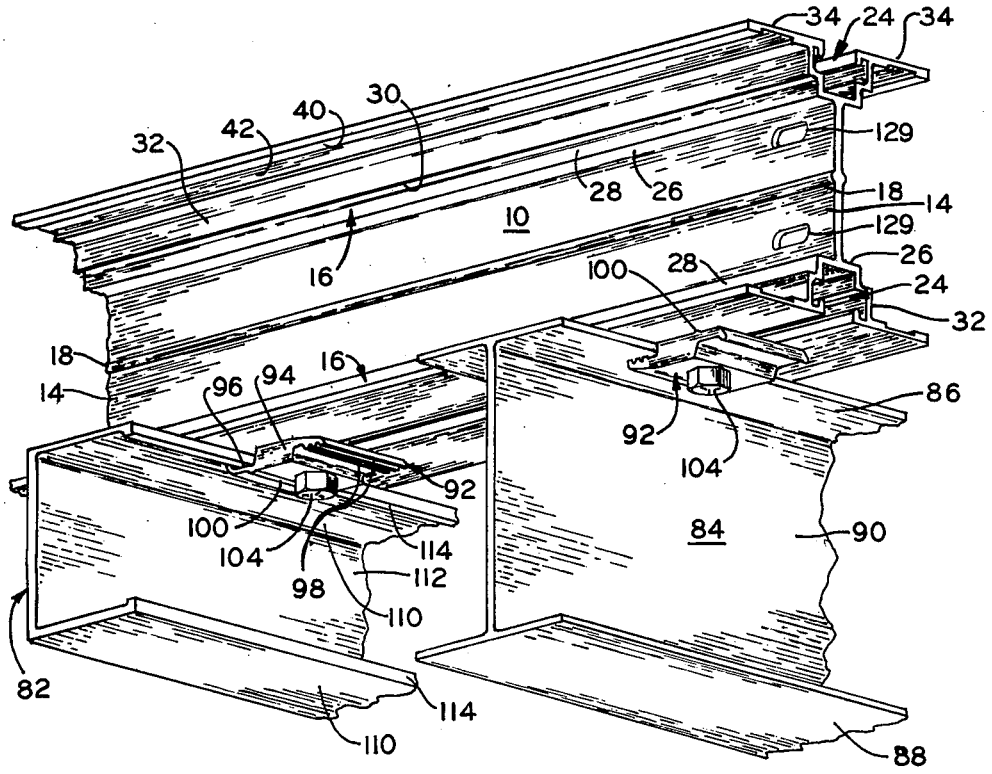
FIG. 4 is a fragmentary perspective view of the improved structural formwork member, showing the same operatively supported in a horizontal position upon a cross channel and a cross I-beam by means of reversible attachment clamps of novel design.

Referring now to FIGS. 4 and 6 of the drawings, and considering the structural member 10 when it is used as a joist or stringer in connection with a concrete slab form installation, the member is supported in a horizontal position while the plywood panel or deck 80 of the form installation is supported on its upper flange arrangement 16 and with its lower flange arrangement 16 supported on suitable structural elements which may be in the form of a horizontal channel strip 82, and a horizontal I-beam 84 as shown in FIGS. 4 and 7, or various other suitable horizontally disposed supporting elements too numerous to mention. It is to be understood that when the structural member 10 is in its operative supporting position with respect to the associated slab form installation, the plywood deck 80 is adapted to have wet concrete poured onto it in order to form a horizontal floor slab. In FIG. 5 of the drawings, the member 10 is illustrated as being supported horizontally upon an I-beam 84 which, in the case of a form installation for an upper floor slab, may be carried on a suitable adjustable structure (not shown) such as that which is shown and described in U.S. Pat. No. 3,130,470, granted on Apr. 28, 1964, and entitled "CONCRETE WALL FORM INSTALLATION." In the case of the form installation being used to form a ground level floor slab, the I-beam 84 may be ground-supported in any number of conventional ways well known in the art.

The I-beam 84 of FIGS. 4, 5, 6 and 7 is of conventional construction and embodies upper and lower horizontally extending I-beam flanges 86 and 88, and a vertically extending connecting web 90. In order to secure the lower flange arrangement 16 of the horizontally positioned structural member 10 to the I-beam 84, a special clamp-type attachment clip 92 is employed, the details of such clip being best shown in FIGS. 4 and 7. The clip is reversible in that when used in connection with an I-beam such as the I-beam 84, it assumes one position, and when used with a channel strip such as the strip 82 (see FIGS. 4 and 7), it is used in an inverted position.

The attachment clip 92 is preferably in the form of a metal extrusion having a generally rectangular body portion 94 with a transverse trough or groove 96 on one side thereof located a slight distance inwards of one transverse edge thereof and with a series of transverse ribs 98 of its other side located inwards of its other transverse edge. A single transverse fulcrum rib 100 is formed on said other side of the body portion 94 at a region opposite to the groove 96, while a bolt-receiving hole 102 is formed centrally in the body portion 94 of the attachment clip 92.

When the attachment clip 92 is used in connection with the I-beam 84, it serves to clamp one side portion of the top flange 86 of the beam against the underneath surfaces of the coplanar seating flanges 34 of the lower flange arrangement 16 of the horizontally disposed structural member 10 and, toward this end, the clip 92 assumes the position (herein referred to as its upright position) in which it is illustrated in FIG. 4 and also at the lower left side of FIG. 6 of the drawings. In such upright position of the clip 92, the ribs 98 face upwardly while the groove 96 faces downwardly. To effect the desired clamping action, a rectangular nut, for example, such as the special nut 66 of FIG. 2, is inserted in the channel 24 in the lower flange arrangement 16 of the member 10 and then a vertically positioned bolt 104 is passed through the hole 102 in the body portion 94 of the clip 92 and caused to be threadedly received in the aforesaid nut, the latter being identical to and positioned within said last mentioned channel 24 in precisely the same manner as described in connection with the nut 66 of FIG. 2. In connection with positioning of the bolt 104, the end region of the attachment clip 92 which embodies the ribs 98 is caused to underlie the adjacent side portion of the I-beam flange 86 as clearly shown in FIG. 4. Thereafter, the bolt 104 is tightened to draw the I-beam 84 and the member 10 against each other. The member thus becomes securely seated upon the I-beam 84, the fulcrum rib 100 affording the necessary rocking action of the attachment clip 92 so that the ribs 98 may engage the underneath side of the adjacent side portion of the I-beam flange 86 with adequate pressure to hold the member 10 firmly and securely seated on such flange.

If the structural member 10 is to be seated upon one or more channel strips such as the channel strip 82, the attachment clip 92 is used in an inverted position as shown at the left lower side of FIG. 4 and the lower left side of FIG. 7. In such instance, the channel strip 82, which embodies a pair of parallel, spaced apart, horizontally extending sides 110 and a vertically extending connecting channel web 112, is positioned so that its uppermost side 110 lies flat against the underneath side of the coplanar seating flanges of the lower flange arrangement 16 of the superjacent horizontally positioned member 10, and then the attachment clip 92 while in an inverted position is manipulated so that the transverse groove 96 in its body portion 94 is caused to receive therein an inturned stiffening rib 114 which is provided on the outer side edge of the upper side 110 of the channel strip 82. The depth of the groove 96 and the width of the rib 114 are such that, upon tightening of the bolt 104 with respect to its captured associated nut 66, the necessary clamping action will be attained and the channel strip 82 and the member 10 will be drawn hard against each other.

The manner in which the plywood deck 80 of the concrete slab form installation of FIGS. 5 and 6 is anchored to the upper flange arrangement of the structural member 10 is precisely the same as the previously described manner of securing the wall form panel 50 of the concrete wall form installation of FIG. 1 to the member 10 and need not be repeated herein, suffice to say that a wooden nailing strip such as the strip 54 of FIG. 1 is inserted in the channel 24 of the upper flange arrangement 26 of said member and then the plywood deck 80 is nailed to such nailing strip as shown in FIG. 5.

Under certain circumstances, a given concrete floor slab installation will necessitate extending the effective length of the structural member 10 or, alternatively, joining one member 10 to a similar second member in end-to-end fashion. In either event, use is made of a pair of the aforementioned extruded extender members 20. In FIG. 5, when considered in connection with FIG. 7 for reference purposes, use of a pair of such extruded extender members 20 for small incremental fill-in or make-up purposes is disclosed. Assuming for purposes of discussion that the structural member 10 of FIG. 5 falls eight or ten inches short of its required effective length, its length may be extended by the use of a pair of the extender members 20. As previously stated, such members are in the form of elongated metal (preferably aluminum) extrusions which may be cut to any desired length as required.

Each extender member 20 as best shown in FIG. 7 of the drawings is generally of channel shape construction and embodies parallel spaced apart side flanges 120 with narrow out-turned coplanar flanges 122 along their distal or outer edge portions. It also embodies a medial bight portion 124 which extends between and connects the proximal or distal edge portions of said flanges 122 and has a longitudinal instruck rib 126 formed in its central region. A longitudinal series of equidistantly spaced holes 128 is formed in the bight portion 124 both above and below the instruck rib 126 and such holes serve a purpose that will be made clear presently. The intermediate web 14 of the structural member 10 is formed with a pair of longitudinally extending slots 129 adjacent to each of its ends (see FIGS. 4 and 7) and are designed for selective registry with the holes 128 in the extender members 20, depending upon the particular fill-in or make-up length which is to be effected. To produce the desired make-up length, the two extender members 20 are positioned in back-to-back relationship as best shown in FIG. 5 and manipulated so that the instruck ribs 126 in their bight portions 124 straddle and overhang the side portions of the rib 18 on the intermediate web 14 of the member, the extent of overhang of the extender members, that is, the distance they project beyond the adjacent end of said member being substantially equal to that of the make-up distance. Bolt and nut assemblies 130 are passed through the registering bolt holes 128 and 129 which are formed respectively in the bight portions 124 of the extender members 20 and the web 14 of the member 10 and such assemblies serve when tightened to clamp the extender members 20 in a fixed position on the adjacent end of said member.

As best shown in FIG. 5 of the drawings, when the extender members 20 are bolted in position on one of the ends of the structural member 10, the outer surfaces of the coplanar seating flanges 34 of the upper and lower flange arrangements 16 are disposed at levels different from those of the outer or distal side edges of the out-turned flanges 122 of the extender members 20 and, therefore, in order to maintain planar continuity of such outer surfaces of the seating flanges with respect to the make-up distance which is afforded by the extender members 20, two wooden filler blocks or strips 132 are seated on the coplanar side flanges 120 of the two extender members both at the top and bottom thereof and are secured in position between the out-turned flanges 122 by dual-headed nails 134 which pass through holes in said flanges 122. The thickness of the filler strips 132 is such that when the strips are in position as described above, the outer (i.e., the upper and lower) surfaces thereof lie flush with and constitute extensions of the upper and lower surfaces of the coplanar seating flanges 34 of the upper and lower flange arrangements of the structural member 10. With the member 10 thus extended to the required distance, the end faces of the filler strips 132 are available for rub rail, guard rail or other attachment purposes by nailing or otherwise.

FIG. 6 of the drawings illustrates the manner in which pieces of lumber may be employed for effecting small longitudinal make-upor fill-in dimensions for the structural member 10 instead of using the metal extender members 20 and the associated filler strips 132. The disclosure of FIG. 6 is sufficiently similar to the previously described disclosure of FIG. 5 that a detailed description of such former view may be avoided by applying identical reference numerals to the two views to designate corresponding parts. Accordingly, the metal extender members 20 are omitted and in their stead a pair of the aforementioned wooden extender members 22 is employed. Such members 22 are positioned in parallel relation on opposite sides of the structural member 10 at the end thereof where the fill-in extension is to be made, and they, as shown in FIG. 6, substantially span the distance between the seating flanges 34 of the upper and lower flange arrangements 16 of the member 10 and also project beyond the adjacent end of the member a distance equal to the required make-up or fill-in distance. As shown in FIGS. 6 and 7, a plywood or other liner member 140 is sandwiched between the inner surface of each wooden extender member 22 and the opposed side of the web 14 of the member 10, such liner member being substantially the same is length as its associated wooden extender member. Longitudinal grooves 142 in the inner side surfaces of the liner members 140 mate and interlock with the side portions of the rib 18 on the central portion of the web 14. To attain planar continuity of the upper surfaces of the coplanar seating flanges 34 of the upper flange arrangement 16, a filler block or strip 144 which is similar in function to the aformentioned filler blocks or strips 132 of FIG. 5 is nailed as indicated at 146 to the upper side edges of the two associated wooden extender members 22. The outer ends of said wooden extender members 22 may be used for rub rail or guard rail attachment purposes as is the case with the wooden filler strips 132 of FIG. 5. Bolt and nut assemblies 148 pass through holes in the wooden extender members 22 and the slots 129 in the adjacent end of the member 10 and serve when tightened to clamp said wooden extender members in position on one end of the structural member 10 with the liner 140 in their sandwiched. position as shown in FIG. 6 and the filler strip 144 in its proper position on the exposed upper side edge surfaces of the extender members 22. It will be understood, of course, that the plywood or other deck 80, in addition to being nailed to the subjacent wooden channel filler strip 54 in the void or channel 24 in the upper flange arrangement 16 of the member 10, may also be nailed to the wooden filler block 144 which it also overlies.

Where in a particular installation of relatively large size it is required that an end-to-end assembly of adjacent structural member 10 be effected, two of the aforementioned extender members 20 may be employed "splicing" purposes, it being necessary merely to position such members so that they are longitudinally aligned and have the contiguous ends thereof in end-to-end relation, and then straddle the abutting end regions of the members by a pair of the extender members 20, utilizing the slots 129 in the webs 14 of the members and the holes 128 in said metal extender members for bolting purposes. Alternatively, a longitudinal series of holes (not shown) may be drilled in the short side wall portions 28 of the upper flange arrangements of the end-to-end structural members for register with preformed holes 150 in the extender members 20, and the sets of registering holes being used for bolting purposes.

Although the extruded metal structural member 10 and its associated attaching facilities or adjuncts, such for example, as the extruded metal extender 20, the wooden extender members 22, the special attachment clips 92, and the various wooden parts 52, 140, etc., have been described herein in connection with the erection of a concrete wall form installation and a concrete slab form installation, it will be understood that such structural member and its associated attachment items may find a wide variety of other uses. Furthermore, although the channels 24 which extend longitudinally along the two flange arrangements 16 have been described as being specially designed for reception of either nailing strips, attachment strips or anchoring nuts, various other channel adjuncts may be inserted or introduced into such channels for reinforcement purposes if desired. For example, and with reference to FIGS. 2 and 3, elongated filler strips or pieces which have not been disclosed herein may be introduced into these channels on either or both sides of the wooden nailing strip 54 for reinforcing purposes if desired, thus filling voids which in the present disclosure remain empty.

The invention is not to be understood as restricted to the details set forth, since they may be modified within the scope of the appended claims, without departing from the spirit and scope of the invention.

Having thus described the invention what I claim as new and desire to secure by letters patent is:

1. A concrete formwork comprising, in combination, a panel against which wet concrete is adapted to be poured in order to produce a concrete slab or wall, an elongated extruded metal structural member for said panel, said member being generally in the form of an I-beam, being adapted in connection with one of its uses to extend horizontally, and having upper and lower flange arrangements connected together by an intermediate substantially planar web, said member being arranged so that one of its flange arrangements is positioned in abutment with the panel, the upper flange arrangement of said structural member embodying a pair of coplanar, horizontally extending bottom wall portions connected to and extending outwardly from the upper longitudinal edge region of the web, a pair of parallel, spaced apart, first side wall portions extending upwards from the bottom wall portions and having their lower edge regions connected to the outer edge regions of said bottom wall portions, a pair of coplanar, horizontally extending, ledge-forming portions extending outwards from the first side wall portions and having their inner edge regions connected to the upper edge regions of said first side wall portions, and a pair of parallel, spaced apart, vertically extending, second side wall portions extending upwards from the ledge-forming portions and having their lower edge regions connected to the outer edge regions of the ledge-forming portions, said second side wall portions being of greater height than the first side wall portions, having the inner opposed surfaces thereof smooth and continuous throughout their entire areas and defining with the ledge-forming portions a channel which is coextensive with the structural member, is of appreciable depth and of generally rectangular cross section, and is spaced from the bottom wall portions by the first side wall portions and the space between the latter, the upper edge regions of said second side wall portions being provided with coplanar inwardly and horizontally extending opposed seating flanges the inner edges of which are spaced apart in order to define a restricted outwardly opening mouth for the channel, said seating flanges being provided on their inner edge regions with short, downwardly extending, rigid, bead-like, right-angle ribs, the upper edge regions of said second side wall portions being further provided with coplanar outwardly and horizontally extending extensions of said seating flanges, the lower flange arrangements being identical in size, shape and construction to the upper flange arrangement but being positioned in inverted or up side down relation with respect thereto, and having the inner edge regions of its coplanar, horizontally extending bottom wall portions connected to the lower longitudinal edge region of the web of the structural member, an elongated wooden reaction nailing strip disposed within the channel of said one flange arrangement, having a width greater than the width of the restricted mouth of said last-mentioned channel and having a depth corresponding to the distance between the inner portions of the ribs and the adjacent faces of the ledge-forming portions to the end that it is securely and firmly captured in the associated channel, and a longitudinal series of fastening members projecting through the panel and extending through said restricted mouth of the one flange arrangement and into said wooden reaction nailing strip, thus drawing the latter against the adjacent ribs of the seating flanges of said one flange arrangement and, in turn, maintaining the last-mentioned seating flanges against the panel so as to connect the structural member to said panel.

2. A concrete formwork as set forth in claim 1 and wherein the formwork is a wall form installation, the structural member is disposed vertically in the manner of a strongback with the seating flanges and seating flange extensions of said one flange arrangement abutting directly against the panel, a nut is slidably disposed within the channel of the other flange arrangement, is interposed between the seating flanges and the ledge-forming portions of said other flange arrangement, bridges the restricted mouth of the channel of said other flange arrangement, and has in its outer face parallel spaced apart grooves which receive and interlock with portions of the adjacent ribs whereby the nut is held against rotation relatively to the structural member, and a pair of horizontal walers traverse the structural member and have their inner edge portions drawn aginst the seating flanges of the other flange arrangements by means of an elongated bolt which passes between said walers and has its inner end threadedly received in said nut and its outer end bearing inwardly against a waler clamping member which embraces the outer edge portions of the walers.

3. A concrete formwork as set forth in claim 1 and wherein the panel and structural member extend horizontally, a nut is slidably disposed within the channel of the other flange arrangement and is interposed between the seating flanges and forming ledge portions of said other flange arrangement, the structural member is supported upon a horizontal supporting element having a lateral flange along its upper edge, said nut bridges the restricted mouth of the channel of said other flange arrangement, and has in its outer face parallel spaced apart grooves which receive and interlock with portions of the adjacent ribs whereby the nut is held against rotation relatively to the structural member, a clamping member is provided for clamping said lateral flange to the seating flanges of said other flange arrangement, said clamping member has a body portion which underlies and extends across the last mentioned seating flanges and embodies a part in overlying relation with said lateral flange, and a bolt projects through said body portion, is threadedly received in said nut, and serves when tightened to draw said part of the clamping member against said lateral flange and thus clamp the latter against said seating flanges.

4. A concrete formwork as set forth in claim 3 and wherein the upper side of said part of the body portion of the clamping member is formed with a series of transversely extending ribs thereon, and a fulcrum rib is provided on the upper side of said body portion in a location remote from said part.

5. An elongated extruded structural member designed for use as a supporting or reinforcing element in connection with formwork for concrete and adapted in certain uses thereof to extend horizontally, said member being generally in the form of an I-beam and having upper and lower flange arrangements connected by a vertical substantially planar web, the upper flange arrangement embodying a pair of coplanar, horizontally extending bottom wall portions connected to and extending outwards from the upper longitudinal edge region of the web, a pair of parallel, spaced apart, vertically extending, first side wall portions extending upwards from the bottom wall portions and having their lower edge regions connected to the outer edge regions of said bottom wall portions, a pair of coplanar, horizontally extending, ledge-forming portions extending outwardly from the first side wall portions and having their inner edge regions connected to the upper edge regions of said first side wall portions, and a pair of parallel, spaced apart, vertically extending second side wall portions extending upwards from the ledge-forming portions and having their lower edge regions connected to the outer edge regions of said ledgeforming portions, said second side wall portions being of greater height than the first side wall portions, having the inner opposed surfaces thereof smooth and continuous throughout their entire areas, and defining with the ledge-forming portions a channel which is coextensive with the structural member, is of appreciable height and of generally rectangular cross section, and is spaced from the bottom wall portions by the first side wall portions and the space between the latter, the upper edge regions of said second side wall portions being provided with coplanar, inwardly extending, opposed, seating flanges the inner edges of which are spaced apart in order to define a restricted outwardly opening mouth for the channel, said channel being adapted for slidable reception thereof of either an elongated wooden reaction nailing strip having a greater width than the width of said restricted channel mouth and a height less than that of the channel or a nut having a greater width than the width of said restricted channel mouth and embodying in its outer face parallel, spaced, apart, transversely extending seating grooves, said seating flanges being provided on their inner edge regions with short, downwardly extending, rigid, bead-like, right-angle ribs which when a wooden nailing strip is disposed in the channel are adapted to confine such strip securely between them and the ledgeforming portions and when a nut is disposed in the channel are adapted to fit within and interlock with the grooves in the outer face of the nut and thereby hold the nut against rotation relatively to the structural member, the upper edge regions of said second side wall portions being further provided with coplanar outwardly extending extensions of said seating flanges, the lower flange arrangement being identical in size, shape and construction to the upper flange arrangement but positioned in inverted or up side down relation with respect thereto, and having the inner edge regions of its coplanar, horizontally extending bottom wall portions connected to the lower longitudinal edge region of the web of the structural element.

* * * * *